United States Patent [19]

Madsen

[11] Patent Number: 4,484,545

[45] Date of Patent: Nov. 27, 1984

[54] HYDRAULICALLY ACTUATED EXHAUST VALVE FOR A RECIPROCATING COMBUSTION ENGINE

[75] Inventor: John G. Madsen, Copenhagen, Denmark

[73] Assignee: B & W Diesel, A/S, Copenhagen, Denmark

[21] Appl. No.: 419,522

[22] Filed: Sep. 17, 1982

[30] Foreign Application Priority Data

Sep. 22, 1981 [DK] Denmark ..... 4192/81

[51] Int. Cl.[3] ..... F01L 1/00

[52] U.S. Cl. ..... 123/90.12; 251/63

[58] Field of Search ..... 123/90.14, 90.32, 90.12, 123/90.13; 137/625.11, 625.13, 625.14, 625.15, 624.11; 251/14, 63, 94, 89; 91/445

[56] References Cited

U.S. PATENT DOCUMENTS

| | | | |
|---|---|---|---|
| 3,209,737 | 10/1965 | Omotehara | 123/90.12 |
| 3,943,825 | 3/1976 | Bianchetta | 91/445 |
| 4,088,151 | 5/1978 | Schorger | 91/445 |

FOREIGN PATENT DOCUMENTS

| | | | |
|---|---|---|---|
| 150218 | 4/1904 | Fed. Rep. of Germany | 123/90.14 |

*Primary Examiner*—Michael Koczo
*Assistant Examiner*—Peggy A. Neils
*Attorney, Agent, or Firm*—Bacon & Thomas

[57] ABSTRACT

The exhaust valve has a valve member which opens away from the combustion chamber of the engine cylinder and which is biased for opening by the gas pressure prevailing in the combustion chamber. The valve is kept closed by an opposed hydraulic pressure which in a holding chamber acts on a holding piston secured to the spindle of the valve member. When the valve is to be opened, the pressure in the holding chamber is relieved and one or more valve controlled flow passages are opened, through which hydraulic liquid flows from the holding chamber to a reservoir defined by a further piston secured to the valve spindle. The two pistons are preferably of substantially equal size. When the exhaust valve is to be closed a hydraulic pressure is applied to a substantially smaller closing piston which is also secured to the valve spindle. During the closing movement hydraulic liquid flows from the reservoir back to the holding chamber and after the closing movement that chamber is again connected to the hydraulic pressure which ensures that the valve member is maintained in its closed position against the gas pressure.

5 Claims, 3 Drawing Figures

HYDRAULICALLY ACTUATED EXHAUST VALVE FOR A RECIPROCATING COMBUSTION ENGINE

BACKGROUND OF THE INVENTION

This invention relates to an exhaust valve for a reciprocating internal combustion engine, such as a two-stroke Diesel engine, and comprising a valve mamber which opens to permit the outflow of gas from the combustion chamber of the engine cylinder by moving away from said chamber, and which is biased in the opening direction by the gas pressure in the combustion chamber and in the closing direction by an oppositely directed hydraulic pressure.

An Article "A novel approach to uniflow scavenge" in the periodical "Marine Propulsion", May 1980, page 13 describes an exhaust valve of this kind, the valve member of which is formed as a piston slide similar to the exhaust piston of the well-known opposed-piston engines, but actuated hydraulically rather than mechanically. A working chamber in a hydraulic actuating cylinder, the piston of which is connected to the slide, communicates with a pressure accumulator via a control valve which is kept closed during the compression and working strokes in the engine cylinder, thereby confining within the working chamber an amount of liquid, which provides the necessary back pressure for keeping the slide closed. When the control valve is opened, the gas pressure drives the slide outwardly whereby hydraulic liquid is transferred from the working chamber to the accumulator. The movement of the slide is retarded by switching the control valve to a throttling position, followed by complete closing of the valve so that the slide remains in its open position until the control valve is re-opened at the termination of the scavenging period, whereby the accumulator pressure moves the slide to its closed position. The control valve is then closed in order to hold the slide against the compression and ignition pressure.

SUMMARY OF THE INVENTION

According to the present invention there is provided an exhaust valve of the kind referred to in the initial paragraph above, which is characterized in that its valve member is rigidly connected with two pistons of substantially different piston areas, each of which is movable in an associated hydraulic cylinder which together with the face of the respective piston remote from the combustion chamber defines a working chamber, that a separate and individually actuated valve is provided for controlling the inflow and outflow of hydraulic liquid to and from each working chamber, whereby the smaller of said pistons serves for closing the valve while the larger piston serves for holding the valve member in its closed position against the gas pressure in the combustion chamber.

By dividing up the closing and holding function on two individually controlled hydraulic cylinders several important advantages are obtained. Because the closing of the valve member occurs against a cylinder pressure, which is far lower than the maximum pressure, the area of the closing piston can be correspondingly smaller than that of the holding piston, and consequently the required amount of high-pressure liquid and, hence, also the power consumption for closing the valve is reduced. Since the working chamber of the holding cylinder can, via its separate control valve, remain connected to the high hydraulic pressure during the entire period in which the exhaust valve is closed, it is possible to design the exhaust valve as a seat valve rather than as a slide which is mandatory in the prior art valve discussed above because the pressure rise in the confined working chamber of the actuating cylinder can result in a compression of the hydraulic liquid with concomitant outward movement of the valve member. A slide requires a considerably larger travel, between its open and closed positions, than a seat valve which implies that the amounts of liquid, which during each working cycle are to be supplied to and discharged from the hydraulic cylinder, and the related power consumption, are correspondingly larger than according to the invention. Furthermore, it is easier to create a reliable sealing along the guide surfaces of a seat valve than with a piston slide.

According to a feature of the invention the two control valves may be arranged to first establish the hydraulic pressure in the working chamber of the closing cylinder and subsequently in the working chamber of the holding cylinder. During the closing movement of the valve the working chamber of the holding cylinder can then be filled at low liquid pressure, e.g. from a reservoir for hydraulic liquid, which is connected to the working chamber of the holding cylinder via a flow path including at least one controlled valve.

The reservior may be formed by a cylinder space which is defined by a third piston secured to the valve member, and the volume of which changes in the inverse sense of the volume of the working chamber of the holding cylinder. This embodiment can be realized by locating the reservoir and the working chamber of the holding cylinder on opposite sides of a partition wall in the valve body which permits to obtain a very short flow path for the rather large quantity of hydraulic liquid which during each working cycle is exchanged between the reservoir and the holding chamber, and thus also a low power loss resulting from the liquid transfer.

It is preferred that the holding piston and the third piston are of equal size because in that case only a minimal supply of high-pressure liquid from outside is required during each working cycle. Furthermore, the embodiment ensures that no excess pressure can occur in the reservoir when the hydraulic liquid is transferred thereto at the opening of the exhaust valve.

The reservoir may communicate permanently with a source of low-pressure hydraulic liquid through a throttled duct. Through said duct any difference between the volumes of the holding chamber and the reservoir can be equalized, including a "surplus" of liquid which stems from the expansion of the amount of liquid flowing from the holding chamber to the reservoir when the exhaust valve is being opened. Additionally, the duct may serve for the removal, from the reservoir, of air which may be liberated from the liquid.

The valve member may be permanently subjected to a small auxiliary force acting in the opening direction. For providing that force the face of the closing piston remote from the working chamber of the closing cylinder may define an annular auxiliary chamber of smaller cross-sectional area than the area of the closing chamber, which auxiliary chamber is permanently connected to a high hydraulic pressure. Alternatively, the face of the holding piston remote from the working chamber of the holding cylinder may define an auxiliary chamber in which a positive pneumatic pressure is permanently maintained. The auxiliary force ensures that the valve opens sufficiently fast also at low engine load when the cylinder pressure is lower than at full load, and in addition it supplements the outwardly directed gas pressure during the final part of the opening movement and at fully open valve.

BRIEF DESCRIPTION OF THE DRAWINGS

The invention will now be described in more detail with reference to the accompanying, somewhat schematical drawings, in which.

DETAILED DESCRIPTION

Figure 1:
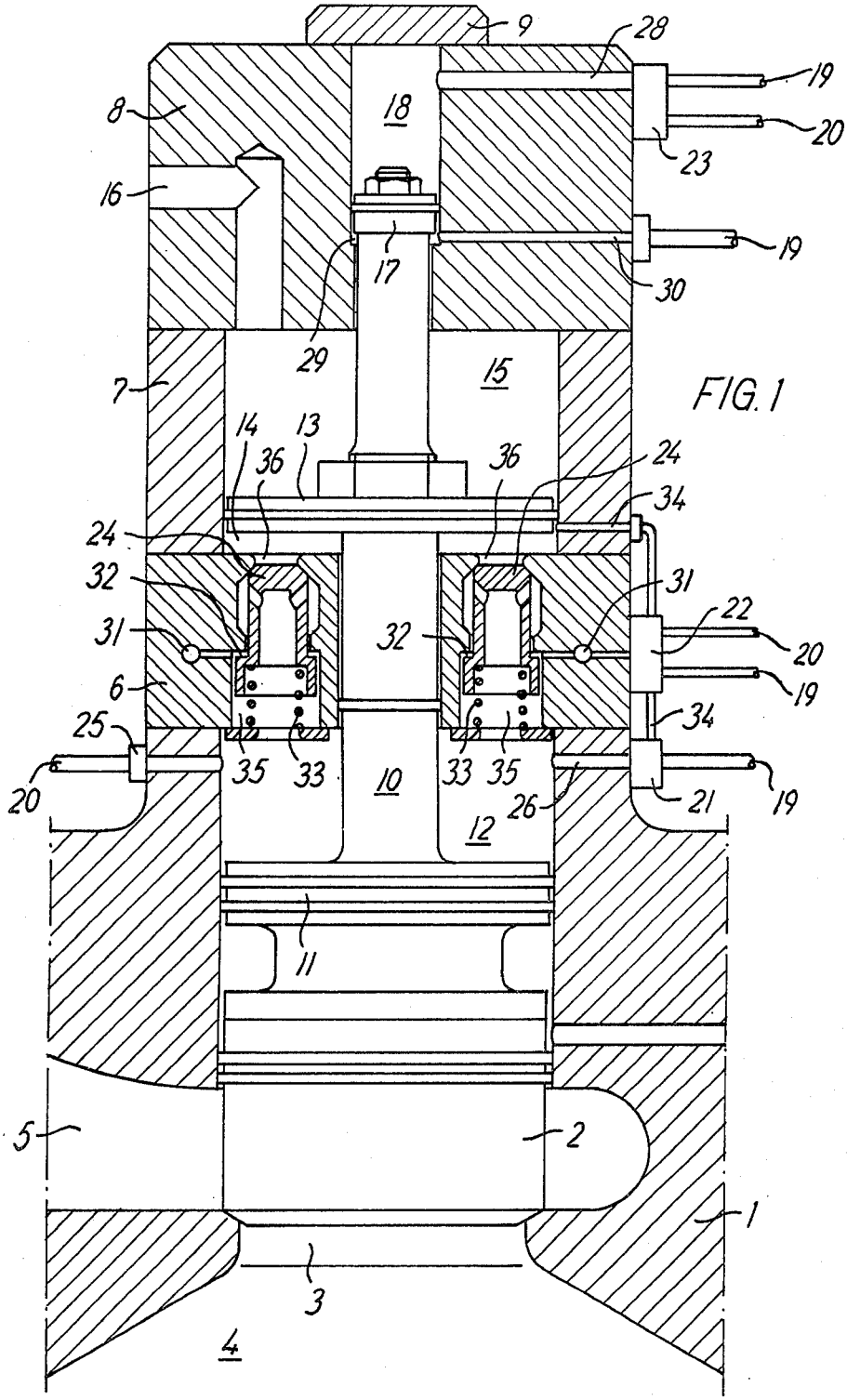
FIG. 1 is an axial section through an embodiment of the exhaust valve of the invention, as mounted on a cylinder of a two-stroke Diesel engine.

In FIG. 1 the exhaust valve is shown mounted in a cylinder cover 1 of a two-stroke Diesel engine (not shown in more detail) with uniflow scavenging. FIG. 1 shows the valve member 2 of the valve in its closed position in which it is seated on an annular seat surrounding a discharge opening 3 from the combustion chamber 4 of the cylinder.

Valve member 2 is guided for axial movement in cylinder cover 1 which has a discharge duct 5 for exhaust gases.

An intermediate block 6 is secured on top of cylinder cover 1, and a second intermediate block 7 is secured on top of block 6. A housing 8 with a top cover 9 is secured on top of block 7.

Valve member 2 is secured to a spindle 10 which extends upwardly through parts 6, 7, and 8. To spindle 10 there is secured a holding piston 11 which together with a cylindric bore in cylinder cover 1 and the lower face of block 6 defines a hydraulic working chamber 12, referred to in the following as the holding chamber. A further piston 13 of the same diameter as piston 11 is secured to spindle 10 and movable within a cylinder bore in block 7. Together with the upper face of block 6 and its bore in block 7 piston 13 defines a reservoir 14 for hydraulic liquid. Chamber 15 above piston 13 is vented to the surroundings through a bore 16 in housing 8. To the upper end of spindle 10 there is secured a piston 17, referred to in the following as the closing piston, which is movable within a bore in housing 8 and which together with said bore and top cover 9 defines a working chamber 18, the so-called closing chamber. FIG. 1 shows schematically sealing means between spindle 10 and the surrounding bore in block 6 as well as between valve member 2, pistons 11, 13, 17 and the respective surrounding cylinder walls.

Figure 2:
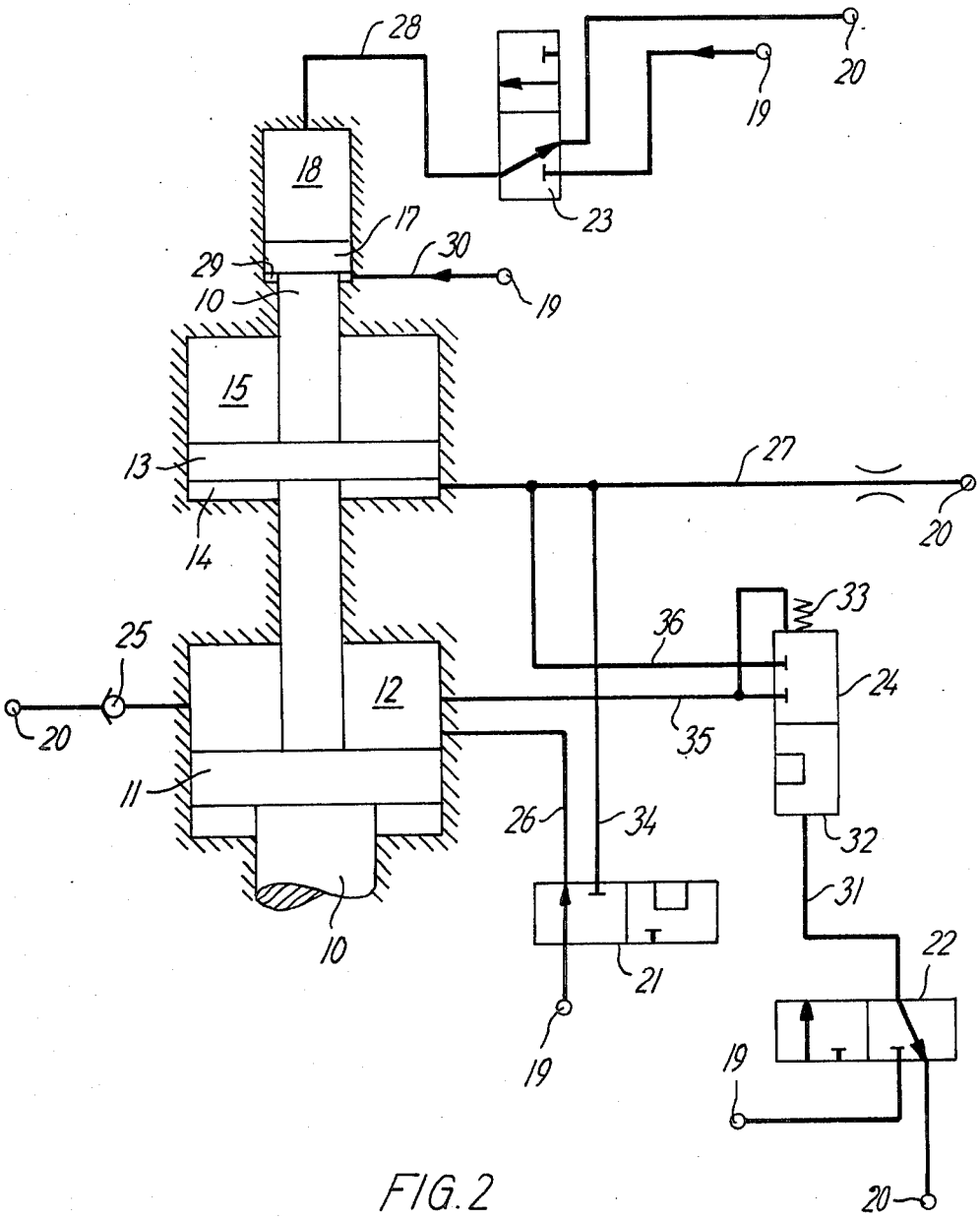
FIG. 2 is a diagram of the hydraulic components of the exhaust valve.

The control of the opening and closing movements of the exhaust valve is effected by means of the valve and duct arrangement shown in FIG. 2 and which forms part of a hydraulic system (not shown in further detail) comprising a high-pressure section supplied from a hydraulic high-pressure pump, and a low-pressure section in which a pressure somewhat higher than the atmospheric pressure is maintained. In FIG. 2 the high-pressure section is indicated by reference numerals 19 pointing to those lines, which are connected to that section, and similarly the low-pressure section is indicated by 20. For an internal combustion engine, in which the maximum cylinder pressure is about 100 bar, the pressure in the high-pressure section can be about 200 bar, and the pressure in the low-pressure section about 1.5 bar.

The hydraulic system comprises three external two-position control valves 21, 22, and 23 and four mutually identical valves 24 which are mounted in block 6 and controlled by valve 22, while in turn they control the flow of hydraulic liquid forth and back between holding chamber 12 and reservoir 14. Furthermore, holding chamber 12 is connected to low-pressure section 20 through a check valve 25 which opens in the direction of the chamber and through which hydraulic liquid can flow into the chamber to compensate for leakage.

Figure 3:
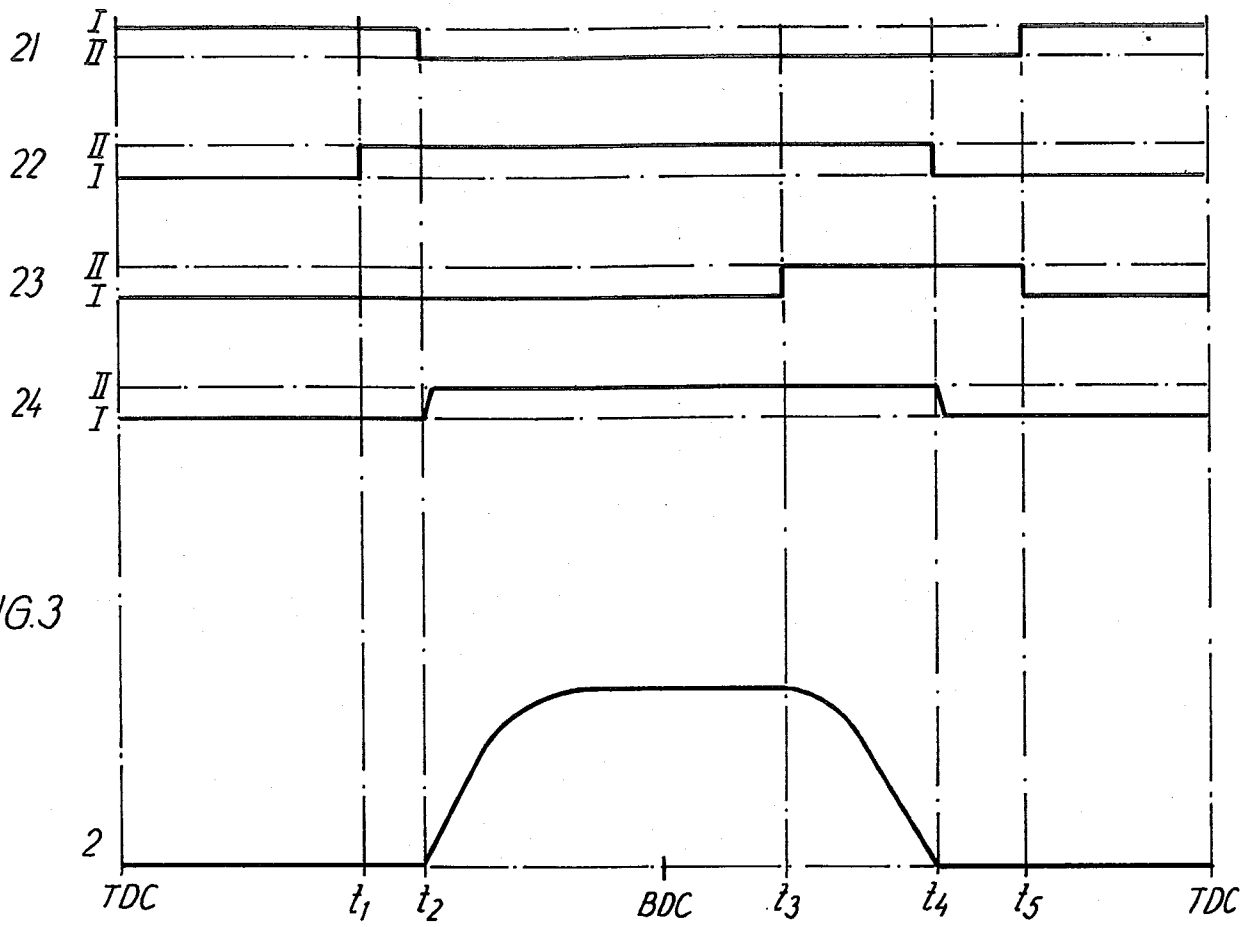
FIG. 3 is a diagram showing the timing of the hydraulic control valves of FIG. 2 and of the exhaust valve proper.

FIGS. 1 and 2 show valve member 2 and control valves 21 to 24 in the positions, which they assume when the piston (not shown) in the engine cylinder is in top dead centre (TDC). Reference is also made to FIG. 3 in which the piston position during a complete working cycle is plotted as abscissa, while as ordinates there are plotted uppermost the positions of each of said control valves 21 to 24 and lowermost the position of valve member 2. In FIG. 3 the positions of the control valves at TDC are indicated by I and their opposite positions by II.

In TDC the high pressure in the high-pressure section 19 of the hydraulic system acts in holding chamber 12 via valve 21 and duct 26, see also FIG. 1. The area of piston 11 is equal to or slightly larger than the area of discharge opening 3, while at the same time the pressure in chamber 12 is considerably higher than the maximum cylinder pressure, and consequently valve member 2 is maintained in its closed position shown. Reservoir 14 is shut off from chamber 12 because valves 24 are closed, and since the reservoir communicates permanently with the low-pressure section 20 via a throttled duct 27, shown in FIG. 2 only, the reservoir pressure is low. Through valve 23 and a duct 28, see also FIG. 1, closing chamber 18 is connected to the low-pressure section 20 while a small annular auxiliary chamber 29 on the underside of closing piston 17 is constantly connected to the high-pressure section through a duct 30. The effective area of chamber 29 is so small that the upwardly directed force on closing piston 17 resulting from the pressure in chamber 29 is insignificant compared with the downwardly directed force which in chamber 12 acts on holding piston 11.

During the working stroke of the engine piston valves 21 to 24 remain in the positions shown until control valve 22 is shifted in response to a command signal, e.g. from a cam on a camshaft rotating in synchronism with the engine crankshaft. This opens for the supply of high-pressure liquid from high-pressure section 19 through ducts 31 in block 6, to the upwardly oriented annular faces 32 on the externally stepped valves 24. This moment is indicated at $t_1$ on the abscissa axis of FIG. 3. For the time being valves 24 remain, however, closed in that on their lower side they are subjected to the high pressure in holding chamber 12 and to the forces of their closing springs 33.

A little later, at time $t_2$, valve 21 is shifted to its other end position in which it shuts off duct 26 from high-pressure section 19 and instead connects it to a duct 34 opening into reservoir 14. This cancels the pressure difference between holding chamber 12 and reservoir 14 and, hence, the differential pressure acting on valves 24. The force acting on the actuating faces 32 of the valves exceeds the force of springs 33 so that the valves move downwardly and open the associated four passages 35, 36 extending between chamber 12 and reservoir 14 in parallel with the valve axis. The pressure equalization between the holding chamber and the reservoir causes the downwardly directed force on holding piston 11 to disappear, and the gas pressure prevailing in combustion chamber 14 is, therefore, capable of lifting valve member 2 to its open position, as shown at the bottom of FIG. 3. During the travel of the valve member the amount of liquid present in chamber 12 is transferred to reservoir 14 through the open passages 35, 36. The small amount of liquid, which was present in closing chamber 18, is expelled, through duct 28 and valve 23, to the low-pressure section 20.

When the engine piston has moved past its bottom dead centre (BDC) and is on its way upward, valve 23 is shifted at time $t_3$. Closing chamber 18 is thereby connected, through the valve, to the hydraulic high-pressure section 19, and the downwardly directed force on closing piston 17 created thereby starts moving spindle 10 and, thus, also valve member 2 downwardly. During this closing movement valves 24 are still open, so that through passages 35, 36 the liquid is transferred unimpededly and without noticeable flow resistance from reservoir 14 to holding chamber 12.

At time $t_4$ which in FIG. 3 is shown as coinciding with the time when discharge opening 3 has been closed, valve 22 is shifted to its position shown in FIG. 2, whereby the actuating pressure on the annular faces 32 of valves 24 is relieved. These valves now start closing under the influence of their closing springs 33, as also shown in FIG. 3.

A little later, at time $t_5$, valves 21 and 23 receive command signals causing them to move to their opposite end positions whereby holding chamber 12 is again pressurized at the high pressure which during the remaining part of the compression stroke and the subsequent working stroke in the engine cylinder ensures that valve member 2 is maintained in its closed position. At the same time the pressure in closing chamber 18 is relieved by the connection of that chamber to the low-pressure section 20. If desired, valve 23 may be shifted later than valve 21.

I claim:

1. An exhaust valve for a reciprocating internal combustion engine comprising: a valve member axially movable towards a combustion chamber of an engine cylinder to close an exhaust passage from said combustion chamber, and away from the combustion chamber to open the exhaust passage, and hydraulic means for maintaining the valve member in a passage closing position, wherein the valve member is rigidly connected with a first piston movable within a first hydraulic cylinder and with a second piston movable within a second hydraulic cylinder, each of said hydraulic cylinders defining together with the faces of said first and second pistons that are oriented away from the combustion chamber a first and second working chamber, respectively; the effective area of said first piston being substantially larger than the effective area of said second piston;

separate duct means connected to each of said working chambers for carrying hudraulic fluid to and from the respective chamber;

a source of high-pressure hydraulic fluid and a source of low-pressure hydraulic fluid; and, a separate control valve provided in each of said duct means for connecting the associated working chamber selectively to the high-pressure source or to the low pressure source in a predetermined sequence.

2. An exhaust valve as claimed in claim 1, further comprising a third piston secured to the exhaust valve member and movable in contact with a surrounding cylinder wall, a reservoir for hydraulic fluid defined by a face of said third piston oriented towards the combustion chamber and by the surrounding cylinder wall, and a flow path connecting the reservoir with the first working chamber and including at least one controlled valve.

3. An exhaust valve as claimed in claim 2, wherein the effective areas of the first piston and the third piston are substantially equal.

4. An exhaust valve as claimed in claim 2 further comprising a throttled duct in a flow path which permanently connects the reservoir to source of low-pressure hydraulic liquid.

5. An exhaust valve as claimed in claim 1, wherein a face of the second piston remote from the second working chamber defines an annular auxiliary chamber of smaller cross-sectional area than the area of the second working chamber, said auxiliary chamber being permanently connected to a zone of high hydraulic pressure.

* * * * *